US008313417B2

(12) United States Patent
Dieter et al.

(10) Patent No.: US 8,313,417 B2
(45) Date of Patent: Nov. 20, 2012

(54) PORTABLE HURDLE

(75) Inventors: William Dieter, Portland, OR (US); Joshua Hoyt, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 13/240,284

(22) Filed: Sep. 22, 2011

(65) Prior Publication Data

US 2012/0015780 A1 Jan. 19, 2012

Related U.S. Application Data

(63) Continuation of application No. 12/262,024, filed on Nov. 25, 2009, now Pat. No. 8,029,412, which is a continuation of application No. 11/714,696, filed on Mar. 5, 2007, now Pat. No. 7,635,319.

(60) Provisional application No. 60/779,398, filed on Mar. 3, 2006.

(51) Int. Cl.
*A63B 5/02* (2006.01)

(52) U.S. Cl. ..... 482/15; 482/129; 482/17

(58) Field of Classification Search ..... 482/14–17, 482/38, 129, 130; 119/705; 124/23.1, 86
See application file for complete search history.

(56) References Cited

U.S. PATENT DOCUMENTS

| | | | | |
|---|---|---|---|---|
| 2,706,631 | A | 4/1955 | Holmes | |
| 2,786,461 | A | 3/1957 | Pelsue, Jr. | |
| 3,055,655 | A | 9/1962 | Chelf | |
| 4,129,916 | A | 12/1978 | Schlesinger et al. | |
| 4,201,177 | A | 5/1980 | Holman et al. | |
| 4,202,316 | A | 5/1980 | Barna | |
| 4,206,740 | A | 6/1980 | Lydon | |
| 4,307,880 | A | 12/1981 | Abram | |
| 4,749,187 | A | 6/1988 | Dellinger et al. | |
| 4,796,598 | A | 1/1989 | Jones | |
| 5,005,828 | A | 4/1991 | Sauerbrey | |
| 5,033,737 | A | 7/1991 | Moye | |
| 5,119,797 | A | 6/1992 | Anderson | |
| 5,199,930 | A * | 4/1993 | Weber | 482/17 |
| 5,433,186 | A | 7/1995 | Corwin | |
| 5,649,520 | A | 7/1997 | Bednar | |
| 6,695,707 | B1 | 2/2004 | Fernandez et al. | |
| 6,968,834 | B1 | 11/2005 | Gibbs | |
| 7,438,668 | B1 * | 10/2008 | Watry et al. | 482/17 |
| 7,611,442 | B1 * | 11/2009 | Myrland | 482/15 |
| 7,635,319 | B2 | 12/2009 | Dieter | |

FOREIGN PATENT DOCUMENTS

GB 2059784 A 3/1981

OTHER PUBLICATIONS

International Search Report, Written Opinion, Transmittal, Preliminary Report; PCT App. No. PCT/US07/05608; Mar. 5, 2007, 11 pages.

* cited by examiner

*Primary Examiner* — Glenn Richman
(74) *Attorney, Agent, or Firm* — Banner & Witcoff, Ltd.

(57) ABSTRACT

A portable hurdle for use primarily athletes has a base portion operably secured to a bow portion that holds the hurdle to a predefined height when the bow portion is placed in tension by a securing structure. The hurdle lays substantially flat when the bow portion is returned to its neutral position. In one disclosed embodiment, the securing structure is a trap that forms the top of the hurdle. In other disclosed embodiments, the base portion defines the top of the hurdle. An adjustment structure allows for adjustment of the hurdle's height.

20 Claims, 5 Drawing Sheets

PORTABLE HURDLE

CROSS-REFERENCE TO RELATED APPLICATIONS

This application is a continuation application of U.S. patent application Ser. No. 12/626,024, filed Nov. 25, 2009, which is a continuation application of U.S. application Ser. No. 11/714,696, filed Mar. 5, 2007, entitled "Portable Hurdle" that has now issued as U.S. Pat. No. 7,635,319, which claims priority to U.S. Provisional Application No. 60/779,398, filed Mar. 3, 2006, the entirety of U.S. application Ser. No. 11/714,696 and U.S. Provisional Application No. 60/779,398 are incorporated herein by reference. The disclosures of all of these applications are hereby incorporated by reference in their entirety for any and all purposes.

STATEMENT REGARDING FEDERALLY SPONSORED RESEARCH OR DEVELOPMENT

Not applicable.

TECHNICAL FIELD

The present invention relates to a hurdle used primarily for athletic events, athletic training, and the like.

BACKGROUND OF THE INVENTION

Hurdles are used in a wide variety of athletic events. For example, some track and field events include placing a series of spaced apart hurdles along a running track. Athletes must cross over the hurdles while competing with each other in a race. These types of hurdles are usually several feet high, and the various athletic organizations have adopted defined heights for the hurdles for a specific racing event, league, or competition.

Similarly, hurdles are also used for training purposes. An athlete positions one or more hurdles along a path and perform training drills that usually include crossing over each hurdle. Training hurdles are usually positioned low to the ground as shown in the attached FIGS. 1A (PRIOR ART) and 1B (PRIOR ART). Common heights for these types of hurdles are between 6 inches to 12 inches from the ground.

It is desirable for hurdles to be economical to manufacture and purchase, portable, easy and compact to store when not in use, easy to set-up and use, easily height adjustable, and easily deflected if contacted during use while remaining stable in wind and the like. To date, known hurdle structures have had limited success with optimizing these desirable characteristics.

BRIEF SUMMARY OF THE INVENTION

The present invention is a portable hurdle that optimizes these desirable characteristics. It is economical to manufacturer and purchase, stores compactly and easily, sets up quickly and easily, can be adjusted to provide a plurality of hurdle heights, remains stable during use even in wind, but collapses easily if inadvertently contacted by the athlete during use.

In disclosed embodiments, the hurdle is formed of a base portion and a bow portion. The bow portion is brought into tension and held in place with a securing device, such as a strap or the like, to form the legs of the hurdle. In one disclosed embodiment, the strap forms the top of the hurdle. In other disclosed embodiments, the base defines the top of the hurdle.

The length of the strap can be adjusted to provide an adjustable height hurdle. In a preferred embodiment, the strap has predefined attachment points so as to set the height of the hurdle to corresponding standard hurdle heights. Alternatively, the strap can be infinitely adjustable, thereby providing an infinitely adjustable height as needed.

In addition to other benefits disclosed herein, the present invention fulfills these needs.

BRIEF DESCRIPTION OF THE SEVERAL VIEWS OF THE DRAWING

The present invention is described in detail below with reference to the attached drawing figures, wherein.

DETAILED DESCRIPTION OF THE INVENTION

A first preferred hurdle structure 20*a* is disclosed in FIGS. 2-7. The base portion 24 is integrally formed with the bow portion 26, thereby defining a monolithic structure. Preferably, the monolithic structure is substantially planar when the bow portion 26 is in its neutral, non-tensioned, configuration 29 shown in FIG. 2.

Figure 8:
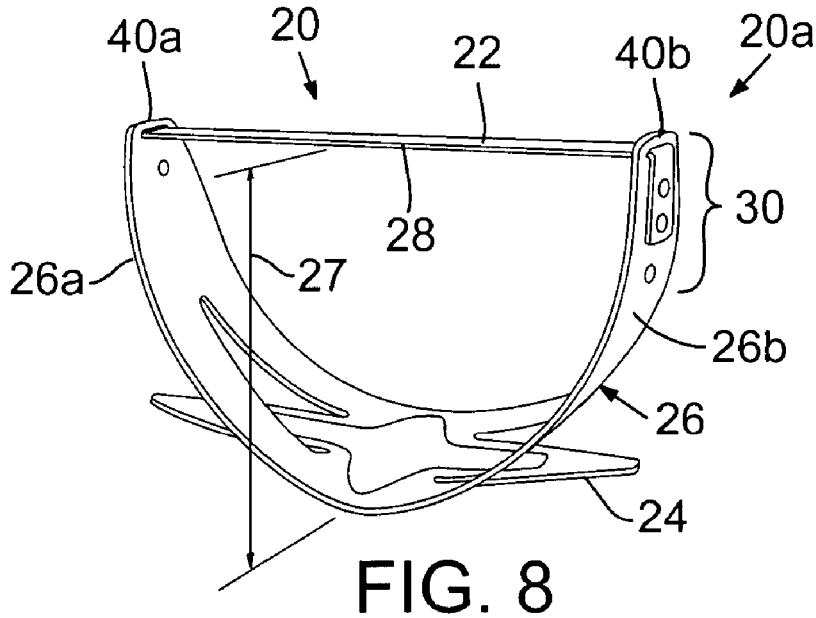
FIG. 8 is a front, right side, isometric view of a first alternative embodiment of a hurdle in accordance with the present invention.

The base portion 24 can straddle the bow portion 26' as shown in FIGS. 1-7, or the base portion 24 can be centered between the bow portion 26 as shown in FIG. 8.

Figure 1A:
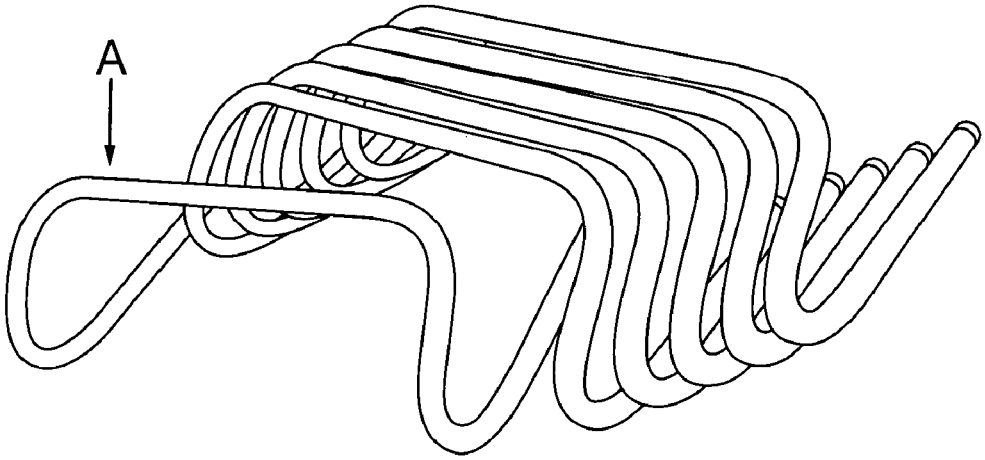
FIG. 1A (Prior Art)
FIG. 1A (PRIOR ART) is a front isometric view of a plurality of prior art hurdles grouped together in a stack for storage.
Figure 1B:
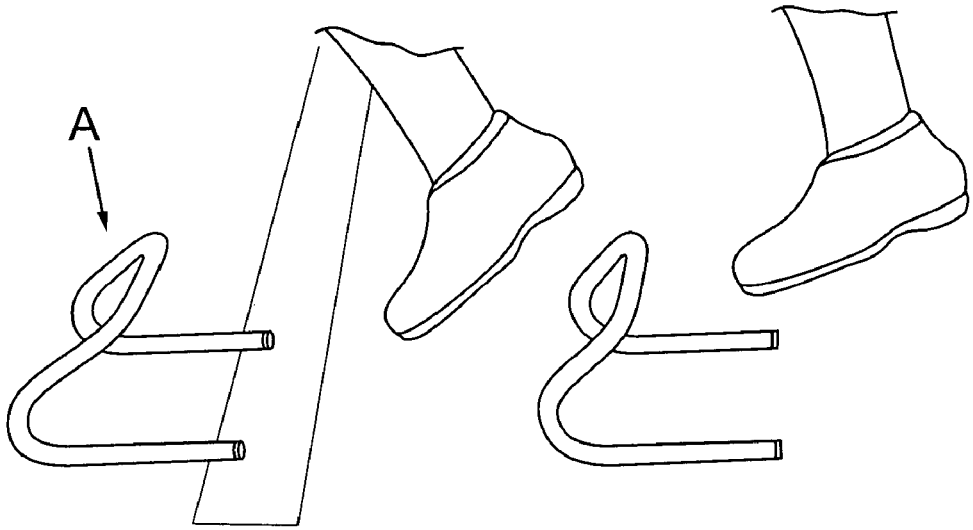
FIG. 1B (Prior Art)
FIG. 1B (PRIOR ART) is a left side isometric view of two hurdles from FIG. 1A (PRIOR ART) showing a possible use by an athlete.
Figure 2:
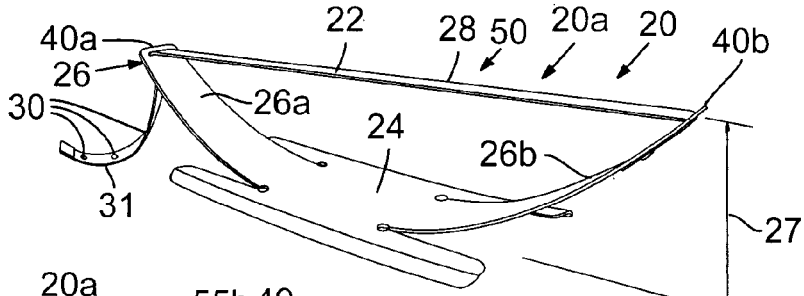
FIG. 2 is a front, right side isometric view of a hurdle in accordance with the present invention showing a first possible height of the hurdle.
Figure 3:
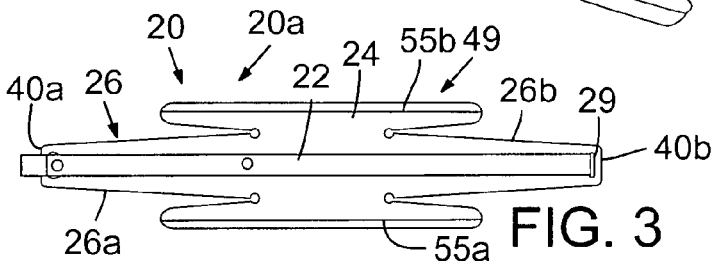
FIG. 3 is a top view of the hurdle of FIG. 2.
Figure 4:
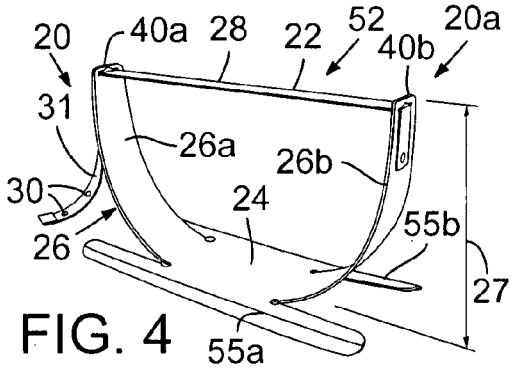
FIG. 4 is a front, right side isometric view of the hurdle of FIG. 2 showing a second possible height of the hurdle.
Figure 5:
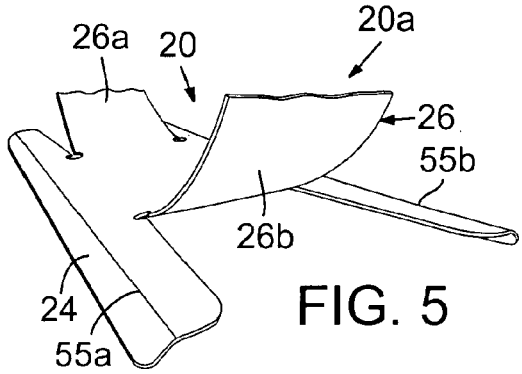
FIG. 5 is an enlarged, partial view of the base portion of the hurdle of FIG. 2.
Figure 6:
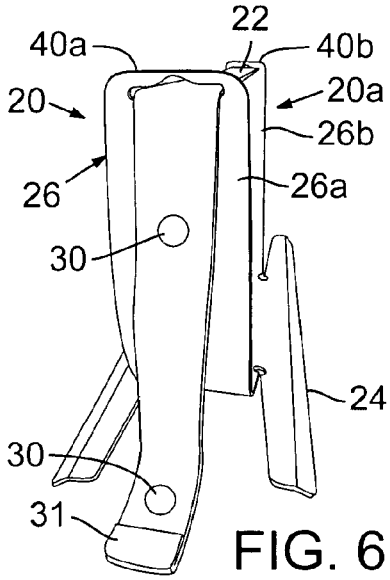
FIG. 6 is a left side, isometric view of the hurdle of FIG. 2.
Figure 7:
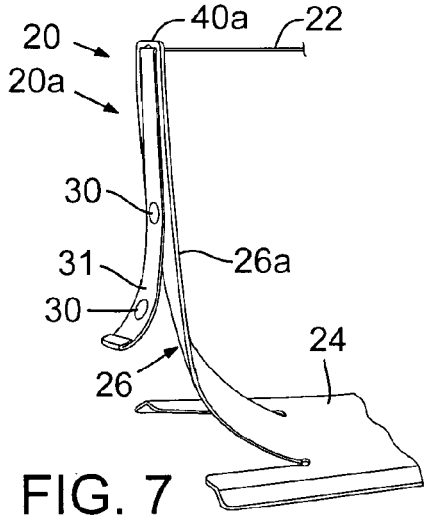
FIG. 7 is an enlarged, partial alternative left side, isometric view of the hurdle of FIG. 2.

The hurdle structure 20*a* of this embodiment is set up by extending the securing device 28, which is preferably a strap or the like, between the ends 40*a*, 40*b* of the bow portion 26 in its neutral position 49 (FIG. 3) and moving the ends 40*a*, 40*b* of the bow portion towards each other, thereby placing the bow portion 26 in tension as best shown in FIGS. 1 and 4. The securing device 28 is operably secured toward the ends 40*a*, 40*b* of the bow portion 26, thereby holding the bow portion 26 in the desired tension position.

Preferably, a plurality of spaced apart attachment structures 30 for operably securing the securing device 28 to the bow portion 26, such as snaps or the like, are positioned along one end 31 of the securing device 28. Accordingly, the height 27 of the hurdle 20 can preferably be adjusted at least between a low position 50 (shown in FIG. 1) and a high position 52 (show in FIG. 4) simply by securing the ends 40*a*, 40*b* of the bow portion 26 to different spaced-apart attachment structures 30. For example, the spaced-apart attachment structures can be aligned so as to allow the height 27 of the hurdle to be 6 inches, 8 inches, and 12 inches depending on which attachment structure 30 is connected by the user. Of course, the hurdle 20 can be sized so as to provide other heights 27 including those used in conventional track and field events and the like.

Preferably, the base portion 24 is folded along its longitudinal length to define fold lines 55*a*, 55*b* as best shown in FIG. 4 to in increase rigidity and support.

Referring to FIGS. 9-14, alternative preferred hurdle structures 20*b-e* are disclosed. In order to prevent undue repetition, like element numbers between the embodiments are like numbered.

Figure 9:
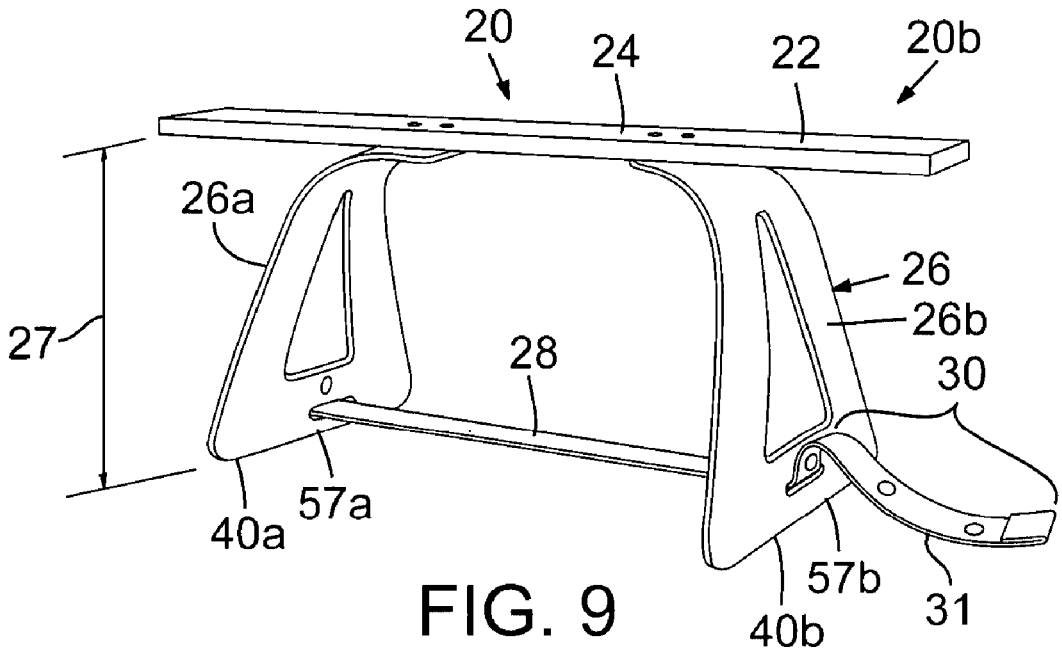
FIG. 9 is a front, right side, isometric view of a second alternative embodiment of a hurdle in accordance with the present invention.

Referring to the hurdle 20*b* embodiment shown in FIG. 9, the base portion 24 is an elongate substantially rigid member and the bow portion 26 includes left and right bow members 26*a*, 26*b*, respectively spaced apart from each other and extending there from. The bow members 26*a*, 26*b* are preferably substantially planar, operably secured to the base portion 24 so as to assume a substantially neutral position when not in tension aligned substantially along the longitudinal centerline of the base portion 24, and have substantially flat distal edges 57*a*, 57*b*.

A user places the bow members 26*a*, 26*b* in tension by moving the distal ends 40*a*, 40*b*, respectively, of each bow member 26*a*, 26*b* toward each other. A securing device 28 that preferably includes a plurality of spaced-apart attachment structures 30 there along operably holds the bow members 26*a*, 26*b* in tension. Preferably, the securing device 28 is a strap that extends between and is operably secured toward the distal ends 40*a*, 40*b* of the left and right bow members 26*a*, 26*b*. The distal edges 57*a*, 57*b* of the bow members 26*a*, 26*b*, rest on the ground while the base portion 24 is elevated substantially horizontally above the ground at a desired height 27 as shown in FIG. 9.

Figure 10:
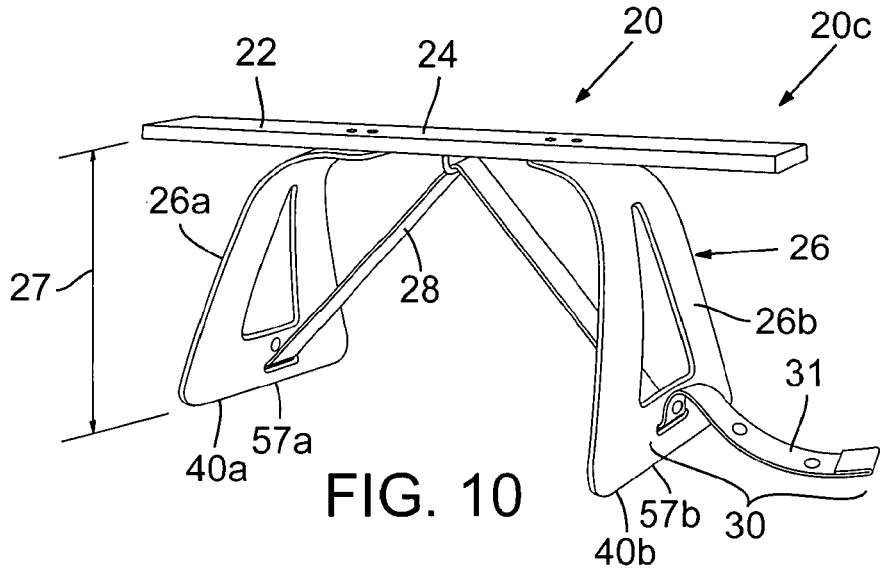
FIG. 10 is a front, right side, isometric view of a third alternative embodiment of a hurdle in accordance with the present invention.
Figure 11:
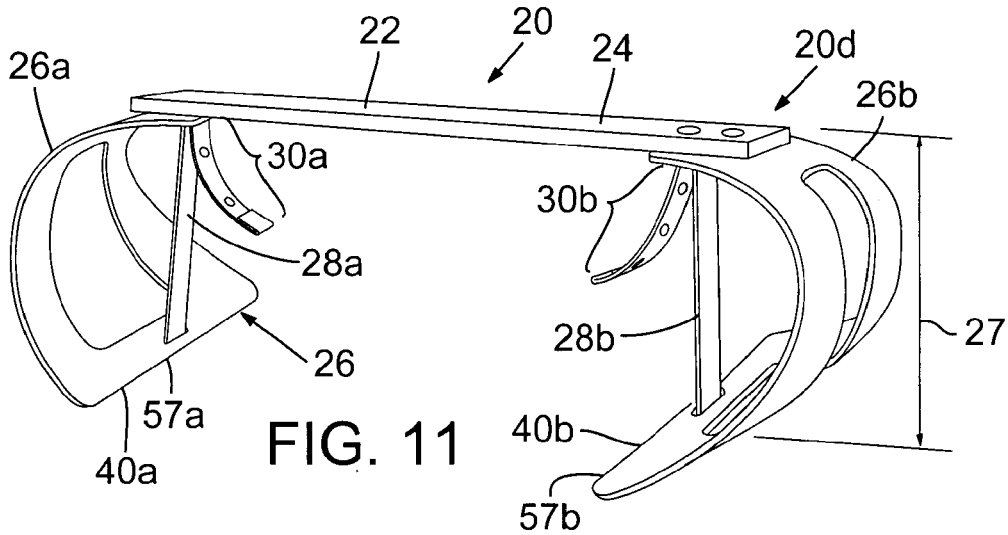
FIG. 11 is a front, right side, isometric view of a fourth alternative embodiment of a hurdle in accordance with the present invention.

In FIGS. 10 & 11, the hurdle 20*c* and hurdle 20*d* are substantially similar in construction as hurdle 20*b* (FIG. 9). However, in order to prevent the securing device 28 from being stepped on during use, the securing device is slidably received through a lower side of the base portion 24 of hurdle 20*c* as shown in FIG. 10. Alternatively, hurdle 20*d* has two straps 28*a*, 28*b* operably extending between the distal ends of the bow member to the base portion as shown in FIG. 11.

The base portion 24, left bow member 26*a*, and right bow member 26*b* can be individual components that are secured together with conventional means and methods. Alternatively, these structures can be integrally formed from a monolithic structure, such as by molding, cutting, forming and the like. In such case, the base portion 24 preferably includes rigidity structures therein, like elongate seams, folds, and the like.

Figure 12:
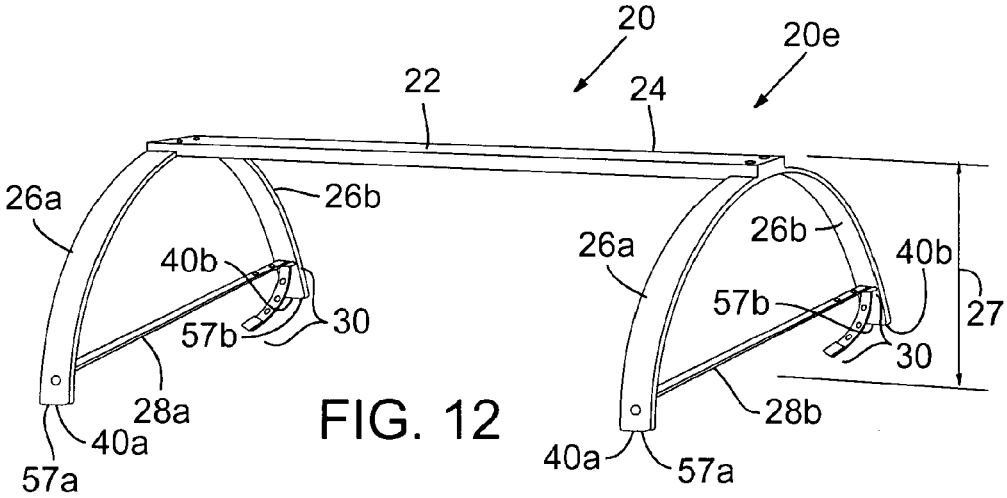
FIG. 12 is a front, right side, isometric view of a fifth alternative embodiment of a hurdle in accordance with the present invention.
Figure 13:
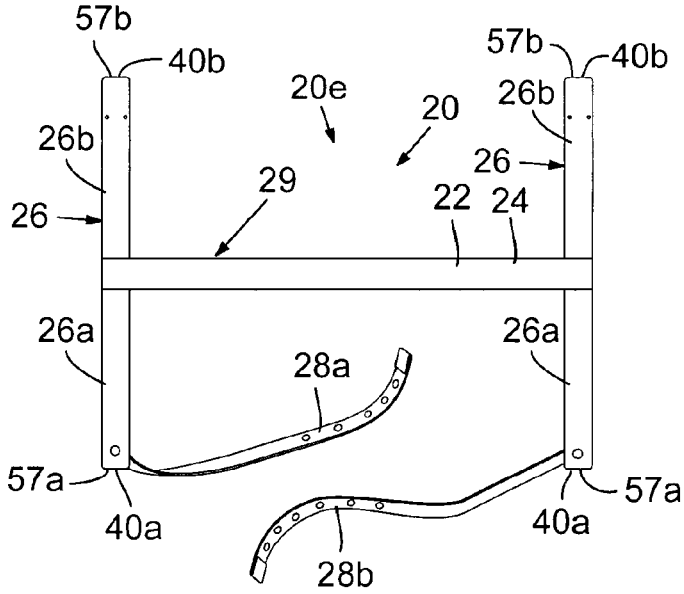
FIG. 13 is a top view of the hurdle of FIG. 12 showing a possible untensioned configuration of the hurdle of FIG. 12.
Figure 14:
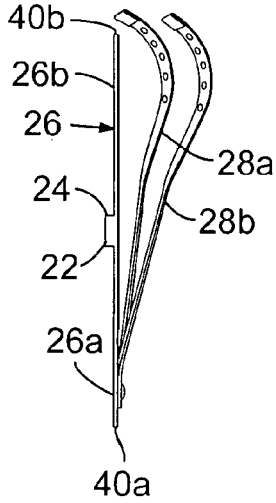
FIG. 14 is a right side view of the hurdle of FIG. 12 is the possible untensioned configuration of FIG. 13.

An alternative hurdle 20*e* embodiment 20*e* is shown in FIGS. 12-14. In this embodiment, the hurdle 20*e* is preferably formed of a monolithic, substantially planar material shown in FIGS. 12 and 13 to define a substantially planar H-shape when in its neutral position shown in FIG. 13. The center of the H defines the base portion 24 with the left and right arms of the H each being a bow portion 26 thereby defining left and right bow portions 26*a*, 26*b*, respectively, on each bow portion 26. Left and right securing devices 28*a*, 28*b* operably hold the respective left and right bow portions in tension, thereby raising the base portion 24 to the desired hurdle height 27 for use.

Preferably, each securing device includes a plurality of spaced apart attachment structures 30 thereby allowing the height of the hurdle to be adjusted.

It can be appreciated that each hurdle can be stored and transported relatively easily simply by detaching the securing devices from their respective bow portions. This causes the tension in the bow portions to be released so that they return to their substantially neutral, planar, position. Accordingly, the hurdles become substantially planar and can be stacked, stored, and carried easily.

To use the hurdles, the user simply attaches securing devices so as to place the bow portions in tension as described. He or she then positions the hurdles as desired and uses them like conventional hurdles.

Having described and illustrated the principles of our invention with reference to a preferred embodiment thereof, it will be apparent that the invention can be modified in arrangement and detail without departing from such principles. For example, although the preferred disclosed securing device has a plurality of spaced apart attachment structures, an alternative attachment structure, such as a slider and clamp, could be used to make the hurdle height infinitely adjustable. Accordingly, in view of the many possible embodiments to which the principles may be put, it should be recognized that the detailed embodiments are illustrative only and should not be taken as limiting the scope of our invention. Accordingly, we claim as our invention all such modifications as may come within the scope and spirit of the following claims and equivalents thereto.

The invention claimed is:

1. A collapsible portable hurdle kit comprising:

a first portable hurdle; and a second portable hurdle, wherein the first portable hurdle and the second portable hurdle each comprise:

a base portion integrally formed with a first bow portion and an opposing second bow portion, the first bow portion defining a first end and the second bow portion defining a second end, wherein at a first configuration the base portion and the bow portions form a substantially planar monolithic structure having a longitudinal length;

a securing device comprising:

a first securing end configured to be operably secured to the first end; and a second securing end configured to be operably secured to the second end to selectively place the portable hurdle in a second configuration;

wherein at the second configuration, the securing device causes the first and second ends of the respective bow portions to flex upward in tension and be separated by a first distance that is less than the longitudinal length; and wherein the first and the second portable hurdles are configured to be placed in a stackable arrangement with respect to each other when each are in the first configuration.

2. The kit of claim 1, wherein at least one of the portable hurdles is configured to be placed in a third configuration, wherein at the third configuration, the securing device further causes the first and second ends of the respective bow portions to flex upward and be separated by a second distance that is less than the first distance.

3. The kit of claim 1, wherein the securing device of the first hurdle is positioned a vertical distance of approximately 6 inches from the base portion when the portable hurdle is in the second configuration.

4. The kit of claim 2, wherein the securing device is positioned a vertical distance of approximately 12 inches from the base portion when the portable hurdle is in the third configuration.

5. The kit of claim 1, wherein at least one of the first end and the second end of the first portable hurdle's resilient bow portion comprises an opening configured to receive the securing structure.

6. The kit of claim 5, wherein each of the first end and the second end of the first portable hurdle's resilient bow portion comprises an opening configured to receive the securing device.

7. The kit of claim 6, wherein for each of the first and the second portable hurdles:

the first securing end of the securing device is configured to be secured to an outer surface of the first end of the resilient bow portion to permit the securing device to pass through the first opening on the first end;

the second securing end of the securing device is configured to be secured to an outer surface of the second end of the resilient bow portion to permit the securing device to pass through the second opening on the second end; and wherein upon the first and second securing ends being secured to first and second ends, respectively, the securing device causes the first and second ends of the respective bow portions to flex upward in tension and be separated by a first distance that is less than the longitudinal length.

8. The kit of claim 7, wherein at least one of the first securing end and the second securing end of the first portable hurdle's securing device comprises an adjustment structure.

9. The kit of claim 7, wherein the first securing end of the first portable hurdle's securing device comprises a first adjustment structure configurable to place the securing device in a first position and a second position;

wherein at a first position, the first adjustment structure engages the first bow portion to cause the first and second ends of the respective bow portions to flex upward away from the base portion from tension between the first and second ends and be separated by a first distance that is less than the longitudinal length and places the first hurdle in the second configuration.

10. The kit of claim 9, wherein the both the first and the second securing ends of the first portable hurdle comprise an adjustment structure.

11. The kit of claim 1, wherein the longitudinal length of the first hurdle is equal to the longitudinal length of the second hurdle when in the first configuration.

12. A collapsible portable hurdle kit comprising:

a first portable hurdle, comprising:

a base portion integrally formed with a first bow portion and an opposing second bow portion, the first bow portion defining a first end and the second bow portion defining a second end, wherein at a first configuration the base portion and the bow portions form a substantially planar monolithic structure having a longitudinal length;

a securing device comprising:

a first securing end configured to be operably secured to the first end; and a second securing end configured to be operably secured to the second end to selectively place the portable hurdle in a second configuration;

wherein at the second configuration, the securing device causes the first and second ends of the respective bow portions to flex upward in tension and be separated by a first distance that is less than the longitudinal length; and wherein the first portable hurdles is configured to be placed in a stackable arrangement with respect to a second portable hurdle when placed in at the first configuration.

13. The kit of claim 12, further comprising a second hurdle comprising:

a base portion integrally formed with a first bow portion and an opposing second bow portion, the first bow portion defining a first end and the second bow portion defining a second end, wherein at a first configuration the base portion and the bow portions form a substantially planar monolithic structure having a longitudinal length;

a securing device comprising:

a first securing end configured to be operably secured to the first end; and a second securing end configured to be operably secured to the second end to selectively place the portable hurdle in a second configuration; and wherein at the second configuration, the securing device causes the first and second ends of the respective bow portions to flex upward in tension and be separated by a first distance that is less than the longitudinal length.

14. The kit of claim 12, wherein the securing device of the first hurdle is positioned a vertical distance of approximately 6 inches from the base portion when the portable hurdle is in the second configuration.

15. The kit of claim 13, wherein at least one of the portable hurdles is configured to be placed in a third configuration, wherein at the third configuration, the securing device further causes the first and second ends of the respective bow portions to flex upward and be separated by a second distance that is less than the first distance.

16. The kit of claim 15, wherein the securing device of the first hurdle is configured to be positioned a vertical distance of approximately 12 inches from the base portion when the portable hurdle is in the third configuration.

17. The kit of claim 12, wherein at least one of the first end and the second end of the first portable hurdle's resilient bow portion comprises an opening configured to receive the securing structure.

18. The kit of claim 17, wherein each of the first end and the second end of the first portable hurdle's resilient bow portion comprises an opening configured to receive the securing device.

19. The kit of claim 18, wherein for each of the first and the second portable hurdles:

the first securing end of the securing device is configured to be secured to an outer surface of the first end of the resilient bow portion to permit the securing device to pass through the first opening on the first end;

the second securing end of the securing device is configured to be secured to an outer surface of the second end of the resilient bow portion to permit the securing device to pass through the second opening on the second end; and wherein upon the first and second securing ends being secured to first and second ends, respectively, the securing device is configured to cause the first and second ends of the respective bow portions to flex upward in tension and be separated by a first distance that is less than the longitudinal length.

20. The kit of claim 18, wherein at least one of the first securing end and the second securing end of the first portable hurdle's securing device comprises an adjustment structure.

* * * * *